US005094646A

United States Patent [19]

Marceau

[11] Patent Number: 5,094,646

[45] Date of Patent: Mar. 10, 1992

[54] CONTROLLER FOR REMOTE TOY VEHICLE

[75] Inventor: Daniel J. Marceau, Springfield, Mass.

[73] Assignee: Milton Bradley Company, East Longmeadow, Mass.

[21] Appl. No.: 559,280

[22] Filed: Jul. 27, 1990

[51] Int. Cl.[5] ..... A63H 30/04

[52] U.S. Cl. ..... 446/491; 273/148 B; 446/456

[58] Field of Search ..... 446/456, 454, 455, 431, 446/230, 491, 154; 273/148 B, 86 B

[56] References Cited

U.S. PATENT DOCUMENTS 4,612,472 9/1986 Kakizaki et al. ..... 446/454 X

FOREIGN PATENT DOCUMENTS 3623697 1/1988 Fed. Rep. of Germany ..... 446/456

*Primary Examiner*—Mickey Yu

*Attorney, Agent, or Firm*—Salter & Michaelson

[57] ABSTRACT

A controller for a remote toy vehicle includes a housing which is formed in the configuration of a control toy vehicle and a control assembly for controlling the operation of the remote toy vehicle. The control assembly includes a manually manipulatable direction control member which is directionally related to the control toy vehicle and manipulatable relative thereto for effecting corresponding movements in the remote toy vehicle.

12 Claims, 3 Drawing Sheets

CONTROLLER FOR REMOTE TOY VEHICLE

BACKGROUND AND SUMMARY OF THE INVENTION

The instant invention relates to remote control toy vehicles and more particularly to a controller which is adapted to facilitate the operation of a remote control toy vehicle.

While various types of remote control toy vehicles, such as toy cars and the like, have become popular with persons of various age groups, it has been found that it is often difficult for an operator to properly relate to the direction of movement of a remote control toy vehicle under all circumstances. In this regard, the controller of a remote control toy vehicle generally includes a joy stick which is movable in various directions to effect movement of a remote toy vehicle in corresponding directions. However it has been found that while it is a relatively simple matter for an operator to manipulate the joy stick of a controller to control the operation of a toy vehicle when the vehicle is headed in a direction away from the operator, it is generally more difficult to control the operation of a toy vehicle when the vehicle is headed in a direction toward the operator. This is because although the direction of movement of a joy stick corresponds directly to the desired direction of movement of a remote toy vehicle when the vehicle is headed in a direction away from an operator, the direction of movement of a joy stick normally corresponds to the direction of movement of a vehicle in a reverse relation when the vehicle is headed toward the operator. In other words, when a toy vehicle is headed in a direction away from an operator left, right or forward movement of the joy stick of a controller normally causes a vehicle to move in corresponding left, right or forward directions relative both to the vehicle and the operator. However, when a vehicle is headed in a direction toward an operator movement of a joy stick to the left causes the vehicle to be moved in a direction which is to the left relative to the vehicle but to the right relative to the operator, and movement of the joy stick to the right causes the vehicle to be moved in a direction which is to the right relative to the vehicle but to the left relative to the operator. Consequently it has been found that it can be difficult for an operator to control a toy vehicle when the vehicle is headed in a direction toward the operator.

The instant invention provides a novel solution to the problem of simplifying the operation of a remote control toy vehicle when the vehicle is headed in a direction toward an operator thereof. Specifically, the instant invention provides a controller for a remote control toy vehicle which enables an operator to more effectively relate to the orientation of the toy vehicle so that the operator can more easily control the operation of the vehicle. Still more specifically the instant invention provides a controller for a remote control toy vehicle comprising a housing which is formed in the configuration of a control toy vehicle and a remote control mechanism in the housing which is operative for remotely controlling the operation of a remote toy vehicle. The remote control mechanism includes means which is directionally related to the control toy vehicle and operative for controlling the remote toy vehicle by manipulating the remote control means relative to the control toy vehicle. In other words, the controller is adapted so that when the remote control means in the control toy vehicle is manipulated in a particular direction relative to the control toy vehicle, the remote control means operates to control the operation of the remote toy vehicle in the same direction relative to the remote toy vehicle. Accordingly, by positioning the control toy vehicle in substantially the same orientation as the remote toy vehicle an operator of the controller can more effectively relate to the orientation of the remote toy vehicle making it easier to control the remote toy vehicle with the controller.

In the preferred embodiment of the controller of the subject invention, the remote toy vehicle and the control toy vehicle are formed as toy car vehicles and they are both of substantially the same configuration. Further, the manually manipulatable portion of the remote control means preferably comprises a joy stick on the control toy vehicle which is movable in left, right and forward directions relative to the control toy vehicle for controlling the operation of the remote toy vehicle in left, right and forward directions thereof, respectively.

A second embodiment the controller of the instant invention comprises first and second control toy vehicles which are of substantially the same configuration and assembled together so that they both face in the same direction and so that when one of the control toy vehicles is in a normal substantially horizontal disposition the other one of the control toy vehicles is in an inverted substantially horizontal disposition. In this embodiment the control means includes first and second manually manipulatable direction control means which are directionally related to the first and second control toy vehicles, respectively, for controlling the operation of the remote toy vehicle in corresponding directions. The control means in this embodiment preferably includes first and second joy stick type controls which are manipulatable relative thereto for controlling the operation of a remote toy vehicle. This embodiment of the controller is adapted so that the entire controller can be turned end over end to reverse the position of the controller relative to an operator so that the operator can more easily relate to the orientation of a remote toy vehicle.

A third embodiment the controller of the instant invention further comprises a handle portion and the control toy vehicle is pivotally mounted on the handle portion for varying the position of the control toy vehicle relative to the handle portion so that the position of the control toy vehicle can be adjusted to correspond to the position of the remote toy vehicle without varying the position of the handle portion relative to an operator. In this embodiment the control toy vehicle and the remote toy vehicle are preferably formed as toy car vehicles of substantially the same configuration. Further, the handle portion is preferably of elongated configuration and the control toy vehicle is preferably secured to the handle portion so that the control toy vehicle is in a substantially horizontal disposition when the handle portion is in a substantially vertical disposition. Still further, the control means preferably includes speed control means including a manually operable trigger on the handle portion for controlling the speed of the remote toy vehicle.

It has been found that the controller of the instant invention can be effectively utilized for controlling the operation of a remote toy vehicle regardless of the orientation of the remote toy vehicle relative to an operator. Specifically, it has been found that because the controller includes a housing which is formed in the configuration of a control toy vehicle and control means which is directionally oriented relative to the control toy vehicle it is possible for an operator to more effectively relate to the orientation of the remote toy vehicle by adjusting the controller so that the position of the control toy vehicle corresponds to that of the remote toy vehicle. Once this has been done, the remote toy vehicle can be easily controlled by manipulating the control means in the control toy vehicle relative to the control toy vehicle to effect corresponding movements in the remote toy vehicle. In other words, because the controller includes a housing which is formed in the configuration of a control toy vehicle it is possible for an operator to easily reorient the controller so that it always corresponds to the position of a remote toy vehicle. Consequently, by properly orienting the controller relative to a remote toy vehicle the controller can be more easily operated by manipulating the joy stick thereof to effect corresponding movements in the remote toy vehicle.

Accordingly, it is a primary object of the instant invention to provide a remote controller for a toy vehicle which is adapted to enable an operator to directionally relate to the position of a remote toy vehicle relative to the operator.

Another object of the instant invention is to provide a controller for controlling the operation of a remote toy vehicle wherein the controller includes a housing portion which is formed in the configuration of a control toy vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
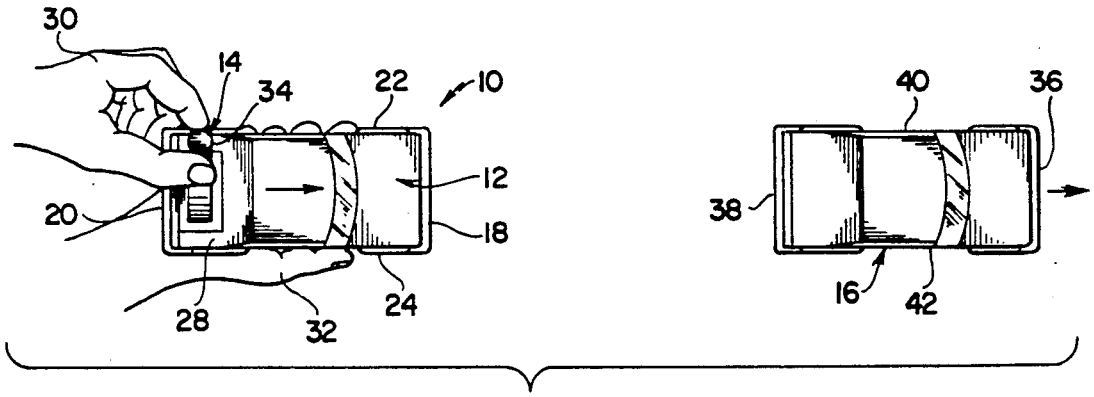
FIG. 3 is a top plan view thereof as the controller is operated for controlling a remote vehicle in a first direction.
Figure 4:
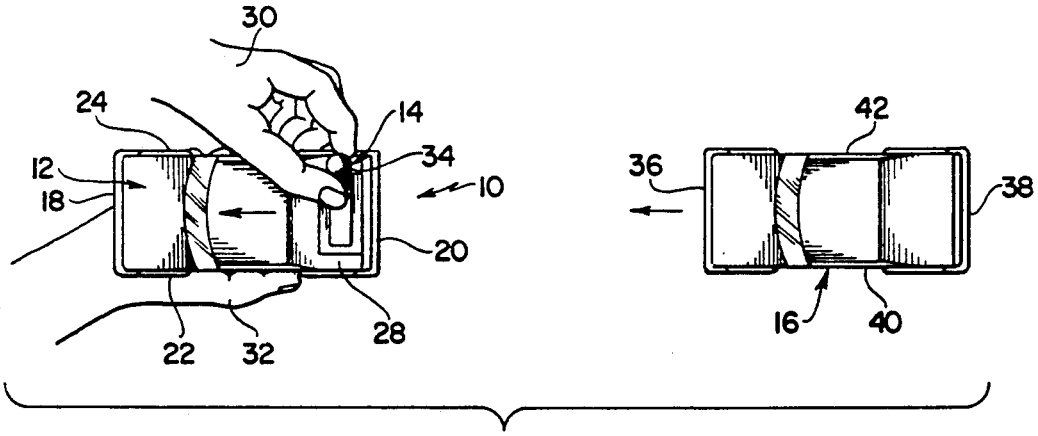
FIG. 4 is a similar top plan view thereof as the controller is operated for controlling the remote vehicle in a reverse second direction.

Referring now to the drawings, a first embodiment of the controller of the instant invention is illustrated and generally indicated at 10 in FIGS. 1–4. The controller 10 comprises a housing generally indicated at 12 and a control assembly generally indicated at 14. As illustrated in FIGS. 3 and 4, the controller 10 is operative for controlling the operation of a remote toy vehicle generally indicated at 16 by manipulating the control assembly 14 relative to the housing 12 in order to effect corresponding movements in the vehicle 16. Accordingly, by positioning the control toy vehicle embodied in the housing 12 in substantially the same orientation as the remote toy vehicle 16 an operator can more effectively relate to the orientation of the remote toy vehicle 16 in order to direct the remote toy vehicle 16 in a desired path of movement.

The housing 12 is preferably molded from a suitable plastic material and it is formed in the configuration of a miniature toy vehicle having front and rear ends 18 and 20, respectively, and left and right sides 22 and 24, respectively. The housing 12 preferably includes integrally molded wheels 26 and it includes a rear deck portion 28 through which the control assembly 14 extends.

The control assembly 14 is preferably of conventional construction and it includes means for transmitting a control signal to the remote toy vehicle 16 in response to corresponding manipulations of the control assembly 14 by a hand 30 of an operator while the controller 10 is held in the other hand 32 of the operator. The control assembly 14 includes a joy stick assembly 34 which is moveable in forward, rearward, left and right directions relative to the housing 12 in order to effect corresponding movements in the vehicle 16 as will hereinafter be more fully set forth.

The toy vehicle 16 is of conventional construction and it is adapted to be remotely controlled by manipulating the control assembly 14 in the controller 10. The vehicle 16 is preferably of substantially the same configuration as the vehicle embodied in the housing 12 and it has front and rear ends 36 and 38, respectively, and left and right sides 40 and 42, respectively.

Referring specifically to FIGS. 3 and 4, the operation of the controller 10 for controlling the operation of the vehicle 16 is illustrated. As will be seen from FIG. 3, when the controller 10 is held in the hand 32 of an operator so that the vehicle embodied in the housing 12 faces away from the operator, the control assembly 14 can be moved toward the left side 22 or the right side 24 of the vehicle embodied in the housing 12 to cause the vehicle 16 to be turned in left or right directions, respectively, which correspond directly to the direction of the movement of the joy stick 24. Similarly, the joy stick 34 can be moved forwardly or rearwardly relative to the housing 12 to effect forward or reverse movement of the vehicle 16 in directions which correspond to the direction of movement of the joy stick 34. On the other hand, when the position of the vehicle 16 is reversed relative to the position of the vehicle embodied in the housing 12, the direction of movement of the vehicle 16 as controlled by the controller 10 is directly opposite from the direction of movement of the joy stick 34. However, because the housing 12 is formed in the configuration of a vehicle, it is a simple matter for an operator to reorient the controller 10 relative to the vehicle 16 so that the control toy vehicle embodied in the controller 10 is always headed in the same general direction as the vehicle 16. As illustrated in FIG. 4, when the positions of the vehicle 16 and the controller 10 are both reversed and the controller 14 is manipulated to control the vehicle 16, the direction of movement of the vehicle 16 again corresponds directly to the direction of movement of the joy stick 34. As a result, by reorienting the controller 10 to correspond to the position of the vehicle 16 an operator can easily and effectively control the operation of the vehicle 16 to effect movement thereof along a desired path.

Figure 1:
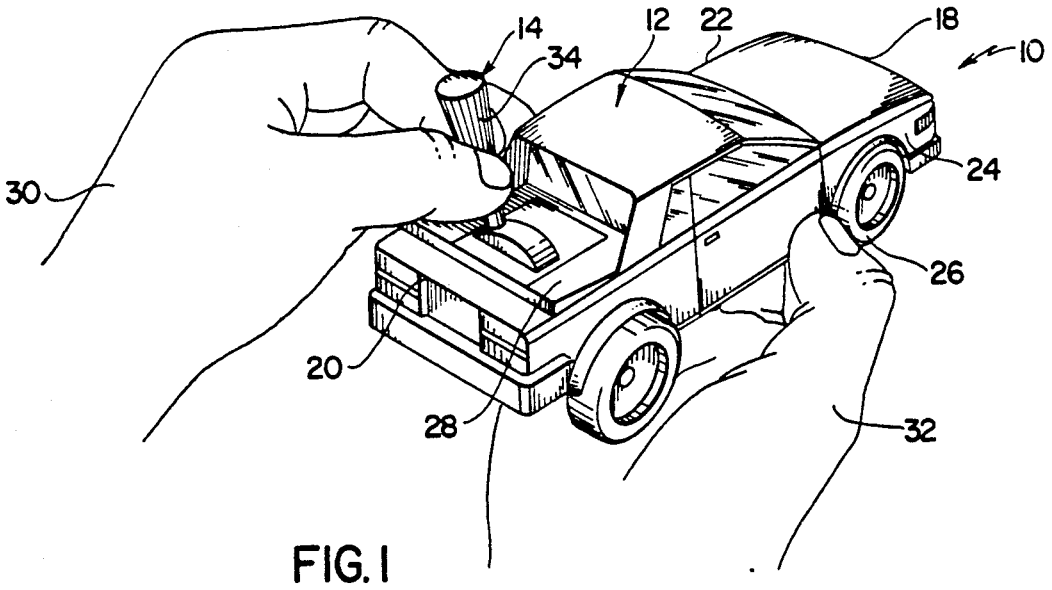
FIG. 1 is a perspective view of a first embodiment of the controller of the instant invention.
Figure 2:
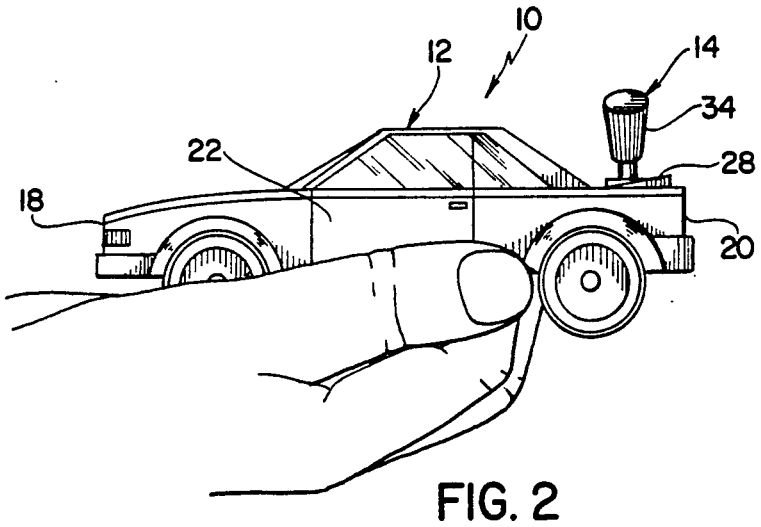
FIG. 2 is a side elevational view thereof.
Figure 5:
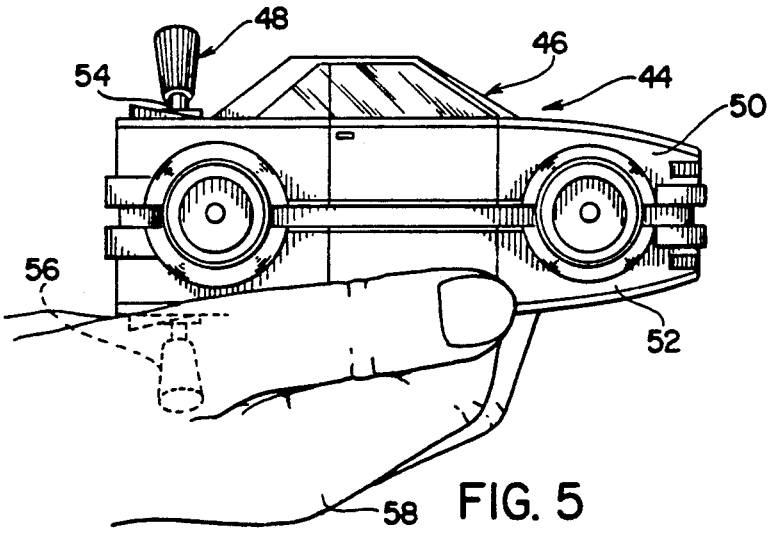
FIG. 5 is a side elevational view of a second embodiment of the controller.

Referring to FIG. 5, a second embodiment of the controller of the instant invention is illustrated and generally indicated at 44. The controller 44 includes a housing 46 and a remote control assembly 48 in the housing 46. The housing 46 includes first and second vehicle portions 50 and 52, respectively, which are of substantially identical configuration and each formed in the configuration of a toy vehicle. The first and second housing sections 50 and 52, respectively, are assembled so that the second housing section 52 is in an inverted disposition relative to the first housing section 50 and so that it faces in the same direction as the housing section 50. The control assembly 48 is operative in a conventional manner for controlling the operation of a remote control vehicle and it includes first and second joy sticks 54 and 56, respectively, which extend outwardly from the first and second housing sections 50 and 52, respectively. The joy sticks 54 and 56 are internally connected in the control assembly 48 so that movement of the first joy stick 54 relative to the first housing section 50 effects corresponding movement of the second joy stick 56 relative to the second housing section 52.

During use and operation the controller 44 is normally held in a hand 58 of an operator and the opposite hand (not shown) of the operator is utilized for manipulating the control assembly 48 to effect movement of a remote toy vehicle, such as the vehicle 16 illustrated in FIGS. 3 and 4. When the remote toy vehicle is facing in a direction away from the operator, the controller 44 is held so that the upwardly facing vehicle portion 50 or 52 is also headed in a direction away from the operator so that the upwardly extending joy stick 54 or 56 can be utilized for controlling the operation of the vehicle 16. However, when the vehicle 16 is headed toward the operator, the position of the controller 44 in the hand 58 can be reversed by turning the controller 44 end over end so that the other housing section 50 or 52 is positioned in an upright disposition wherein the vehicle embodied therein is headed in a direction toward the operator. The upwardly extending joy stick 54 or 56 can then be manipulated to control the movement of the vehicle 16 and since the upwardly facing vehicle 50 or 52 is facing in a direction toward the operator, the direction of movement of the vehicle 16 corresponds directly to the direction of movement of the upwardly extending joy stick 54 or 56.

Figure 6:
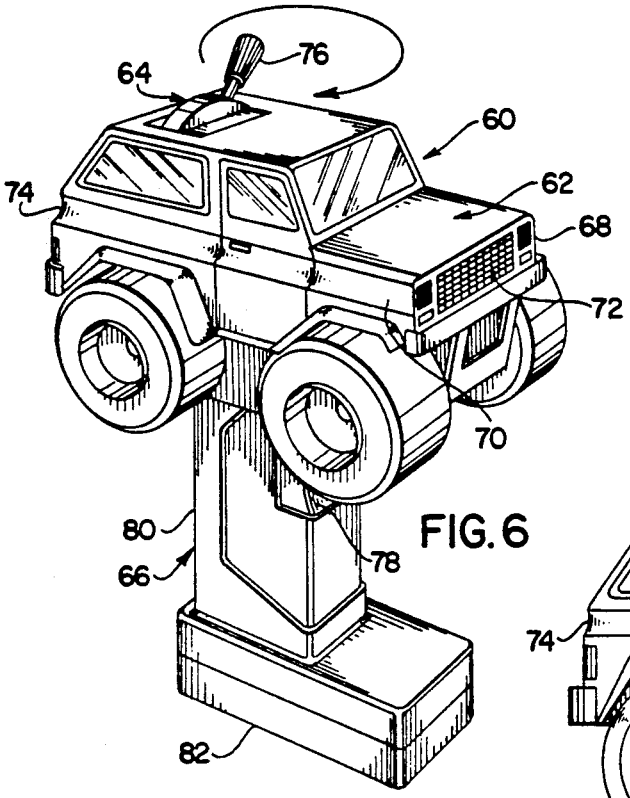
FIG. 6 is a perspective view of a third embodiment of the controller.
Figure 7:
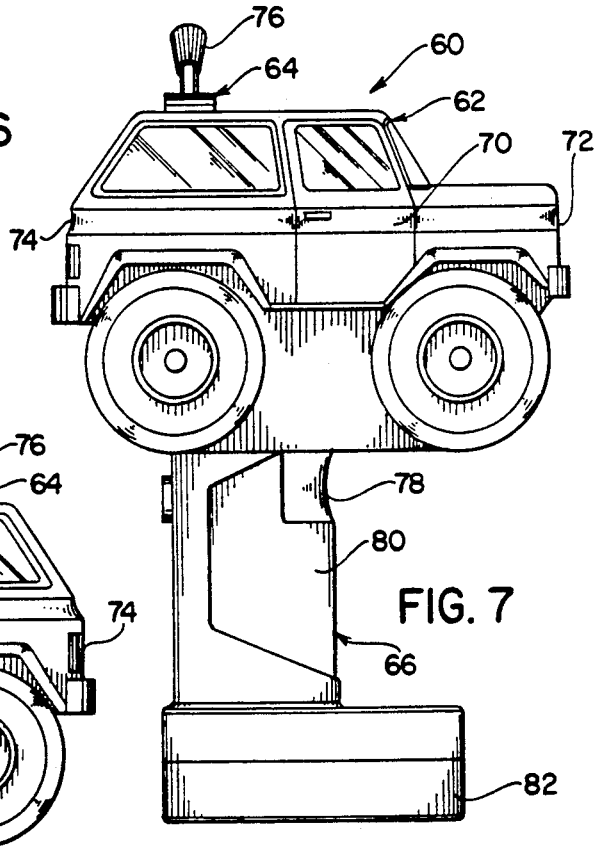
FIG. 7 is a side elevational view of the third embodiment of the controller in a first position.
Figure 8:
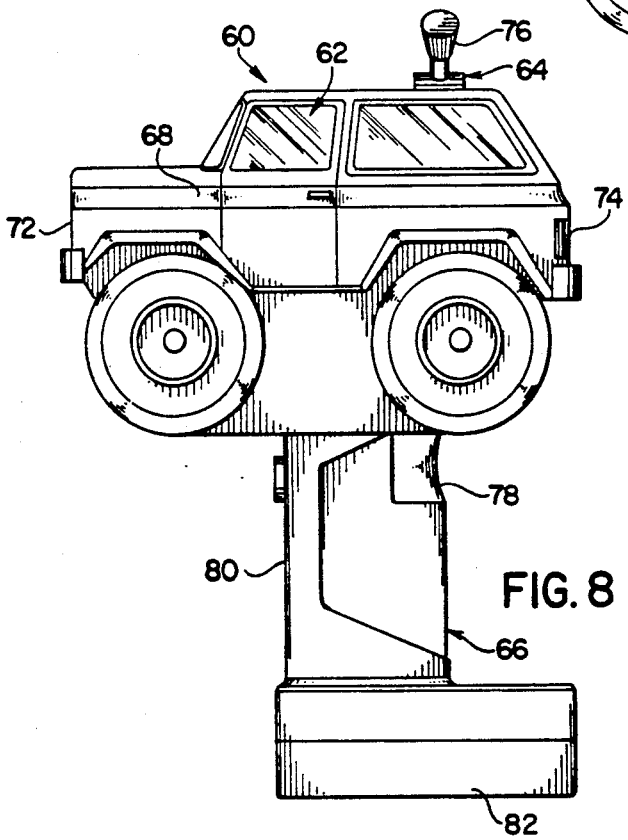
FIG. 8 is a side elevational view of the third embodiment of the controller in a second position.

Referring now to FIGS. 6–8, a third embodiment of the controller of the instant invention is illustrated and generally indicated at 60. The controller 60 comprises a housing generally indicated at 62, a control assembly generally indicated at 64 and a handle assembly generally indicated at 66. The housing 62 is preferably integrally molded from a suitable plastic material in the configuration of a miniature toy vehicle as illustrated and it has left and right sides 68 and 70, respectively, and front and rear ends 72 and 74, respectively.

The control assembly 64 is of conventional construction and it is preferably similar to the control assembly 14 hereinabove described in connection with the controller 10. The control assembly 64 includes a joy stick 76 which is manually manipulatable in left, right, forward and reverse directions relative to the housing 62 in order to control the operation of a remote vehicle. The control assembly 64 further includes a speed control comprising a trigger 78 which is mounted on the handle assembly 66. The trigger 78 is squeezable relative to the handle assembly 66 for controlling the speed of a remote vehicle, such as the vehicle 16, in a conventional manner. The handle assembly 66 comprises a hand grip portion 80 and a base 82 on the lower end of the hand grip portion 80. The trigger 78 is positioned on the hand grip portion 80 so that it is squeezable by the forefinger of an operator grasping the hand grip portion 80 for controlling the speed of a remote toy vehicle. The base 80 is constructed so that it is operative for supporting the controller 60 on a supporting surface and it is integrally formed on the lower end of the hand grip portion 80. The housing 62 is pivotally attached to the upper end of the handle assembly 66 so that the housing 62 and the portions of the control assembly 64 contained therein are pivotable relative to the handle assembly 66. As illustrated, the housing 62 is pivotable about a substantially vertical axis when the handle assembly 66 is in a substantially vertical disposition for reorienting the housing 62 and the portions of the controller 64 mounted therein relative to the handle assembly 66.

The use and operation of the controller 60 is generally similar to that of the controller 10. Specifically, the housing 62 and the portions of the remote control assembly 64 therein are reoriented relative to a remote vehicle, such as the vehicle 16, in order to position the housing assembly 62 in substantially the same orientation as the remote vehicle. Accordingly, an operator of the controller 60 can more effectively relate to the orientation of the remote vehicle when operating the control assembly 64 to effect forward, reverse, and steering movement of the remote vehicle. Further, because the controller 60 includes a handle assembly 66 the vehicle embodied in the housing 62 can be pivoted relative to the handle assembly 66 to more easily reorient the housing 62 relative to an operator so that the orientation of the vehicle embodied in the housing 62 corresponds to orientation of the remote toy vehicle. However, because the trigger 78 is mounted on the handle assembly 66 the position of the trigger 78 remains in a convenient location for manipulation with the forefinger of an operator regardless of the position of the housing 62 relative to the handle assembly 66.

It is seen therefore that the instant invention represents a significant advancement in the art relating to remote control toy vehicles. Specifically, the controllers 10,44 and 60 all include housing portions which are formed in the configurations of toy vehicles so that operators thereof can more effectively relate to the orientations of the toy vehicles controlled with the controllers 10,44 and 60. Specifically, the vehicles embodied in the controllers 10,44 and 60 can be reoriented to correspond to the positions of remote toy vehicles which are controlled by the controllers 10,44 and 60. As a result, the vehicles embodied in the housings of the controllers 10,44 and 60 can be oriented so that the joy sticks of the controllers 10,44 and 60 can be manipulated in various directions to effect corresponding movements in toy vehicles. Hence, the controllers 10,44 and 60 are adapted to make it substantially easier for operators to control remote toy vehicles in desired paths of movement. For these reasons the instant invention represents a significant advancement in the toy art which has substantial commercial merit.

While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A controller for controlling the operation of a remote toy vehicle, said remote toy vehicle being selectively operable in left, right and forward directions relative to said remote toy vehicle, said controller comprising:

a) a housing including a control toy vehicle portion formed in the configuration of a control toy vehicle, said control toy vehicle having left and right sides; and b) remote control means attached to said housing and operative for remotely controlling the operation of said remote toy vehicle, said control means including manually manipulatable direction control means directionally related to the left and right sides of said control toy vehicle portion for controlling the operation of said remote toy vehicle in at least left and right directions thereof, respectively.

2. In the controller of claim 1, said remote toy vehicle and said control toy vehicle portions both being configured as toy car vehicles.

3. In the controller of claim 1, said remote toy vehicle and said control toy vehicle portion both being of substantially the same configuration.

4. In the controller of claim 1, said manually manipulatable means comprising a control stick on said housing which is movable in left, right and forward directions relative to said control toy vehicle portion for controlling the operation of said remote toy vehicle in at least left and right directions thereof, respectively.

5. The controller of claim 1 further comprising a handle portion, said housing being pivotally mounted on said handle portion for varying the position of said control toy vehicle portion relative to said handle portion.

6. In the controller of claim 5, said housing being pivotally mounted on said handle portion for reversing the position of said control toy vehicle portion relative to said handle portion.

7. In the controller of claim 6, said control toy vehicle portion and said remote toy vehicle both being configured as toy car vehicles.

8. In the controller of claim 6, said handle portion being of elongated configuration and having an upper end, said housing being pivotally mounted on the upper end of said handle portion for supporting said control toy vehicle portion in a substantially horizontal disposition when said handle portion is in a substantially vertical disposition.

9. In the controller of claim 8, said remote toy vehicle being selectively operable at different speeds, said remote control means further comprising speed control means on said handle portion for controlling the speed of said remote toy vehicle.

10. In the controller of claim 9, said speed control means including a manually operable trigger on said handle portion, said trigger being manipulatable for controlling the speed of said remote toy vehicle.

11. In the controller of claim 1, said control toy vehicle portion comprising a first control toy vehicle portion, said housing further comprising a second control toy vehicle portion of substantially the same configuration as said first control toy vehicle portion, said second control toy vehicle portion being positioned in an inverted disposition on the underside of said first control toy vehicle portion and facing in substantially the same direction as said first control toy vehicle portion, said remote control means including first and second manually manipulatable direction control means directionally related to the left and right sides of said first and second control toy vehicle portions, respectively, said first and second manually manipulatable direction control means being manually manipulatable relative to the left and right sides of their respective control toy vehicle portions for controlling the operation of said remote toy vehicle in left and right directions thereof, respectively.

12. In the controller of claim 11, said first and second direction control means including first and second control sticks on said first and second control toy vehicle portions, respectively, said first and second control sticks being movable in left and right directions relative to their respective control toy vehicle portions for controlling the operation of said remote toy vehicle in left and right directions thereof, respectively.

* * * * *